US005086473A

United States Patent [19]

Erath

[11] Patent Number: 5,086,473

[45] Date of Patent: Feb. 4, 1992

[54] FEEDBACK SYSTEM FOR A SUB-WOOFER LOUDSPEAKER

[75] Inventor: Louis W. Erath, P.O. Box 177, Abbeville, La. 70511-0177

[73] Assignee: Louis W. Erath, Abbeville, La.

[21] Appl. No.: 442,518

[22] Filed: Nov. 27, 1989

[51] Int. Cl.[5] ..... H04R 3/00

[52] U.S. Cl. ..... 381/96; 381/59

[58] Field of Search ..... 381/96, 59

[56] References Cited

U.S. PATENT DOCUMENTS

| | | | |
|---|---|---|---|
| 2,968,695 | 1/1961 | Corliss et al. | 381/96 |
| 3,525,812 | 8/1970 | Verdier | 381/96 |
| 4,243,839 | 1/1981 | Takahashi et al. | 381/96 |

FOREIGN PATENT DOCUMENTS

| | | | |
|---|---|---|---|
| 3630478 | 1/1988 | Fed. Rep. of Germany | 381/96 |

*Primary Examiner*—Forester W. Isen
*Attorney, Agent, or Firm*—Arnold, White & Durkee

[57] ABSTRACT

The present invention provides an apparatus for enhancing the low frequency response of a loudspeaker. At low frequencies the mechanical and electrical inefficiencies of loudspeakers limit the intensity of the sound output by the loudspeakers. Previous attempts to correct the inefficiencies have been hampered by the non-ideal circuit elements used in conventional feedback circuits. To enhance the low frequency response of a loudspeaker there is provided an apparatus which includes a feedback circuit which is operably connected to an audio amplifier and which is tuned to substantially match the impedance of the loudspeaker within a predetermined frequency range. The apparatus further includes a transformer having a primary winding and a secondary winding. The primary winding is adapted to connect to the drive coil of a loudspeaker, and the secondary winding is connected to the feedback circuit. The feedback circuit delivers a feedback signal which alters the audio input signal in response to a voltage induced on the secondary winding by the primary winding, and compensates for the low frequency inefficiencies of the loudspeaker.

28 Claims, 3 Drawing Sheets

FEEDBACK SYSTEM FOR A SUB-WOOFER LOUDSPEAKER

BACKGROUND OF THE INVENTION

1. Field of the Invention

This invention relates generally to sound reproduction systems, and more particularly to an improved feedback system which compensates for the nonlinear characteristics of a signal-to-sound transducer, such as a loudspeaker.

2. Description of the Related Art

In the field of sound reproduction it is well known that the sound level produced by conventional loudspeakers diminishes near the limits of human hearing. For instance, at low frequencies, the mechanical and electrical characteristics of a loudspeaker tend to reduce the sound level output by the loudspeaker. This is primarily caused by the current limiting effects of the series resistance inherent in the speaker's drive coil at low frequencies.

There have been many attempts to compensate for these undesirable characteristics so that constant sound output from a loudspeaker can be achieved over the entire range of human hearing. These attempts have been made because the response of the human auditory system is not constant and varies with the frequency and intensity of sound waves. These inefficiencies of the human auditory system and the need for an appropriate compensation system for a loudspeaker are discussed in greater detail in U.S. Pat. No. 3,449,518 issued June 10, 1969 to Erath.

One method for compensating the low frequency inefficiencies of a loudspeaker is described in the above-mentioned patent. The patent discloses a degenerative feedback network which attempts to maintain constant level of sound output from a loudspeaker. The loudspeaker is driven by a broad-band audio amplifier, and the circuit elements of the feedback network are tuned to match the low frequency response of the loudspeaker. The feedback network receives a current signal from the voice coil of the loudspeaker and delivers a degenerative feedback signal to an input of the broadband audio amplifier. Since the degenerative feedback signal is "tuned" to cancel the undesirable response of the voice coil, the low frequency response of the loudspeaker is improved.

One embodiment of the feedback network includes an inductor and a capacitor which are selected to be equivalent to the fundamental resonance of the speaker cone. The network further includes a resistor which is selected to represent the lumped mechanical resistance in the loudspeaker and an inductor that is selected to be equivalent to the leakage inductance of the voice coil In other words, the frequency compensation network is selected to be equivalent to the impedance of the loudspeaker throughout the frequency range of the loudspeaker.

In theory the frequency compensation network should function quite well and produce a constant sound output level from the loudspeaker over its entire frequency range. In practice, however, this constant output level could not be achieved. This is primarily due to the non-ideal characteristics of the circuit elements of the frequency compensation network. For instance, inductors have some finite resistive component which interferes with the theoretical ideal characteristics of the feedback network. Therefore, the frequency compensating feedback network disclosed in the previously mentioned patent, while being an improvement in the art, does not fully correct the problem.

Another attempt to correct the low frequency inefficiencies of a loudspeaker is disclosed in U.S. Pat. No. 4,335,274 issued June 15, 1982 to Ayers. To overcome basic defects in the low frequency response of a loudspeaker, two degenerative feedback circuits are provided which attempt to alleviate an impedance peak and an impedance valley in the low frequency range of the loudspeaker. A first feedback circuit applies degenerative feedback, proportional to the current flowing through the drive coil, to an audio amplifier; and a second feedback circuit applies degenerative feedback, proportional to voltage induced in feedback coil which is disposed about the voice coil of the loudspeaker, to the audio amplifier. However, one problem with this type of compensation system is that the speaker must be modified to accept the feedback coil. Another problem exists because reactive elements are used in the feedback circuits, and these reactive elements include non-ideal characteristics as mentioned previously.

Another method of compensating for the low frequency response characteristics of a loudspeaker utilizes a transducer to sense the sound pressure level output by the loudspeaker. In response to the sound pressure level, a feedback signal, proportional to the sound output level of the loudspeaker, is applied to an associated audio amplifier. While this does raise the low frequency response of a loudspeaker, it does not necessarily provide a constant sound output level. Moreover, the transducers themselves have limited frequency response characteristics, and, therefore, cannot fully overcome the poor low frequency response characteristics of the associated loudspeaker.

SUMMARY OF THE INVENTION

In accordance with one aspect of the present invention, there is provided an apparatus for enhancing the low frequency response of a loudspeaker. The loudspeaker preferably includes an acoustic wave producing member, and a drive coil having a first and a second terminal. The drive coil is adapted to produce movement of the acoustical wave producing member. Advantageously, the loudspeaker is powered by an audio amplifier which delivers an amplified audio signal to the loudspeaker. The apparatus includes a feedback circuit which is operably connected to the audio amplifier and which is tuned to substantially match the impedance of the loudspeaker within a predetermined frequency range. Also included is a transformer having a primary winding and a secondary winding. The primary winding is adapted to connect to the second terminal of the drive coil, and the secondary winding is connected to the feedback circuit. The feedback circuit delivers a feedback signal which alters the audio input signal in response to a voltage induced on the secondary winding by the primary winding.

The feedback circuit preferably includes a operational amplifier which is adapted to receive an audio input signal and to deliver an amplified audio input signal to the input of the audio amplifier. A frequency compensating circuit has an input which is connected to the secondary winding of the transformer and an output which is connected to the input of the operational amplifier. The frequency compensating circuit delivers a feedback signal in response to a voltage induced on the secondary winding by the primary winding, and the feedback signal has a phase and magnitude which alters the audio input signal to cause the audio amplifier to output a driving signal that is correlative to the amplified audio input signal and that compensates for impedance variations of the drive coil.

The feedback circuit also preferably includes a resonance matching circuit which is tuned to electrically match the impedance of the loudspeaker within a predetermined frequency range. The resonance matching circuit is adapted to receive the driving signal and to deliver an output signal which alters the feedback signal in response to the frequency of the driving signal.

In accordance with another aspect of the present invention, there is provided a method for enhancing the low frequency response of a loudspeaker. The loudspeaker preferably includes an acoustic wave producing member, and a drive coil which is adapted to produce movement of the acoustical wave producing member. The method includes the steps of delivering a current signal to the drive coil; electrically matching the impedance of the loudspeaker in response to the current signal; sensing current flowing through the drive coil, while being electrically isolated from the impedance of the drive coil; and altering the magnitude of the current signal in response to the frequency of the sensed current.

BRIEF DESCRIPTION OF THE DRAWINGS

The advantages of the invention will become apparent upon reading the following detailed description and upon reference to the drawings in which.

Figure 1:
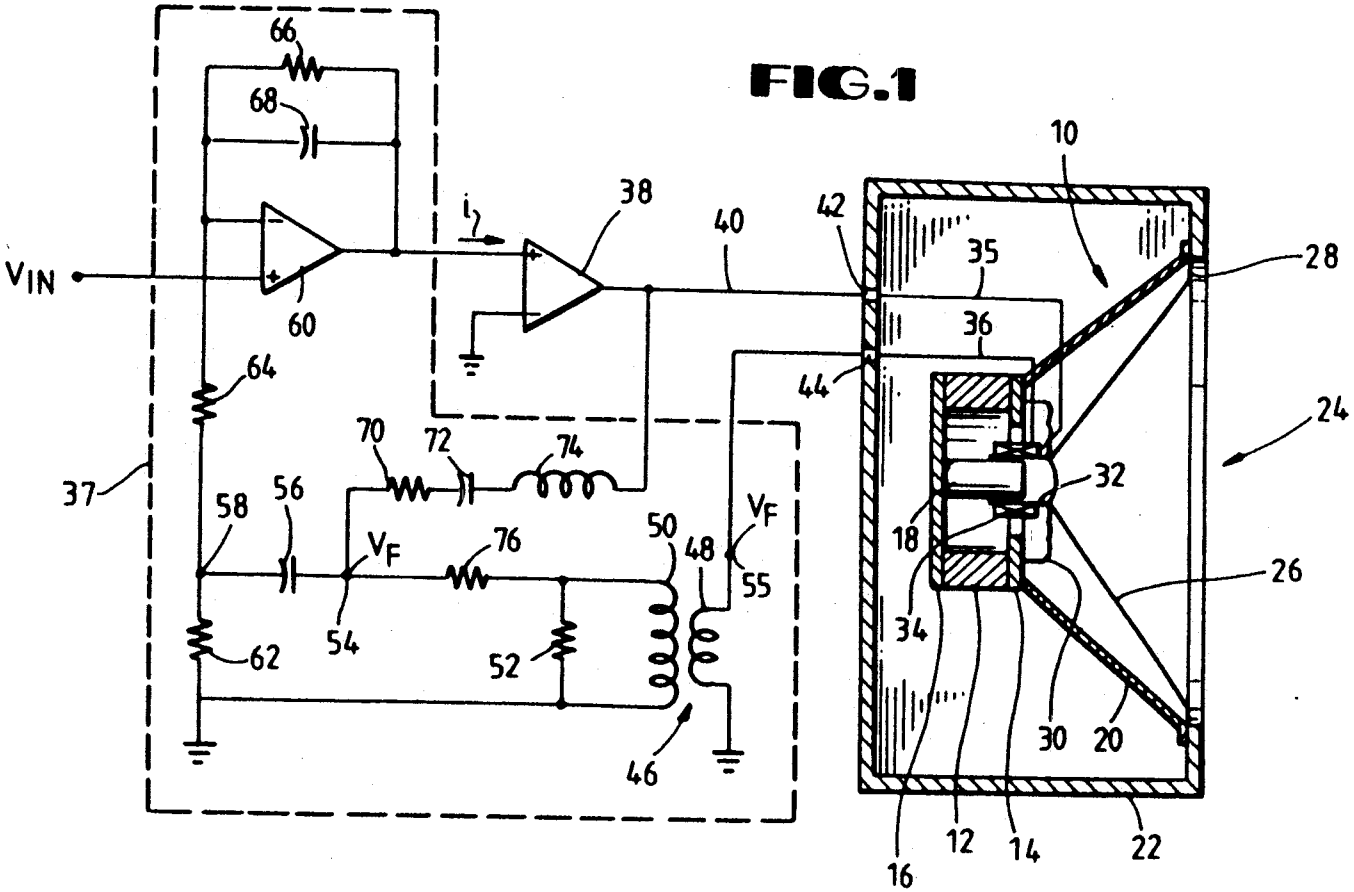
FIG. 1 is a schematic diagram which represents a preferred embodiment of a frequency compensating feedback system for a loudspeaker in accordance with the present invention, and FIG. 1 also includes a detailed representation of a loudspeaker and its associated enclosure.

While the invention is susceptible to various modifications and alternative forms, specific embodiments thereof have been shown by way of example in the drawings and will be described in detail herein. It should be understood, however, that it is not intended to limit the invention to the particular forms disclosed, but on the contrary, the invention is to cover all modifications, equivalents, and alternatives falling within the spirit and scope of the invention as defined by the appended claims.

DESCRIPTION OF THE PREFERRED EMBODIMENT

Turning now to the drawings and referring initially to FIG. 1, a loudspeaker is shown and generally designated by a reference numeral 10. The loudspeaker 10 is preferably a sub-woofer which is designed to emit acoustical waves having frequencies below about 200 hertz. For instance, if the frequency response of a loudspeaker system rolls off below 100 hertz, then a sub-woofer which is designed to enhance frequencies below 100 hertz could be used with the loudspeaker system to extend the frequency response to the lower limits of human hearing (about 20 hertz).

The loudspeaker 10 includes an annular magnet 12 which is mounted in a magnetic structure between a front plate 14 and a back plate 16. The annular magnet 12 encompasses a pole piece 18 to produce a magnetic flux which is used to drive the loudspeaker 10. A conically-shaped basket 20 is connected to the front plate 14 and extends outwardly therefrom in order to accurately position a cone 26 adjacent the magnetic structure. The cone 26 is typically made of a lightweight material, such as paper, plastic, metal, or composite material, to enhance the response of the loudspeaker 10. The cone 26 is suspended by a surround 28 which connects the cone 26 to the outwardly extending edge of the basket 20, and by a spider 30 which is attached to the outer periphery of a cylindrical form 32 such that the cylindrical form 32 is disposed concentrically about the pole piece 18. A drive coil 34 is disposed about the cylindrical form 32 so that changes in current through the drive coil 34 alter the magnetic field between the magnet 12 and the pole piece 18 and cause the cylindrical form 32 to slide axially along the pole piece 18.

Preferably, the axial length of the drive coil 34 should be about three times the thickness of the front plate 14 so that the cone 26 is capable of large excursions while maintaining a substantially constant number of turns of the drive coil 34 in the intense portion of the magnetic field. This helps avoid distortion at the low frequencies produced by the sub-woofer. Moreover, the cone 26 should be fairly rigid and it should move as a piston in a selected lower frequency range, e.g., from about 20 hertz to about 200 hertz. The light weight of the cone 26 makes the cone more efficient at converting alternating current into sound pressure. Furthermore, the suspension, i.e., the surround 28 and the spider 30, should be compliant to allow an excursion of at least +/−0.25 inches. With this type of construction, the mass of the cone 26 and the stiffness of the suspension should resonate at about 30 hertz in free air, as shown by a curve A in FIG. 2.

Figure 2:
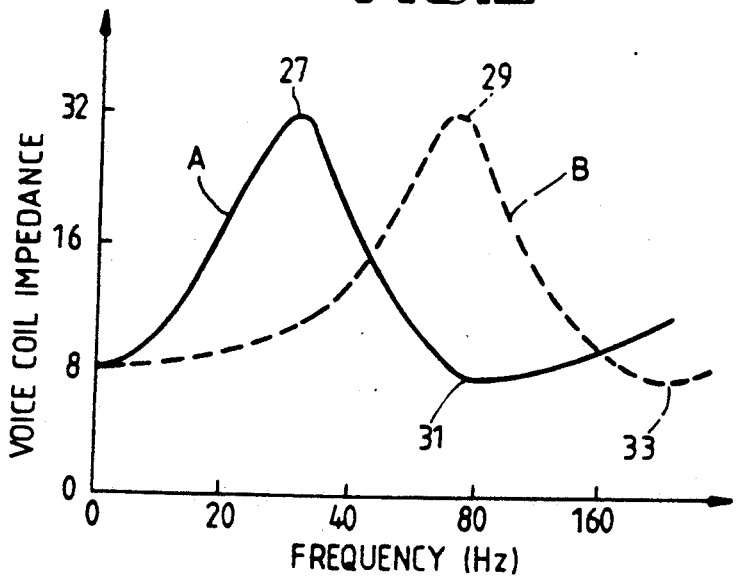
FIG. 2 is a graph of drive coil impedance vs. frequency.

Preferably, the loudspeaker 10 is mounted in a cabinet 22 in order to raise the resonance of the cone 26 to about 70 hertz, as shown by a curve B in FIG. 2. The cabinet 22 is totally enclosed in that it has no ports other than an opening 24 in which the loudspeaker 10 is mounted, and the cubic volume of the cabinet 22 is such that the stiffness of the air within the cabinet 22 adds support to the cone 26. Preferably, the cabinet 22 is small compared to the wavelength of the sound waves produced by the loudspeaker 10. Therefore, at frequencies below the peak resonance of the cone 26, the impedance of the loudspeaker 10 is substantially controlled by the stiffness of the air within the enclosure 22. At frequencies above the resonance of the cone 26, the impedance of the loudspeaker 10 is controlled by the mass of the suspended system, which includes the cone 26 and the voice coil 34.

The impedance peaks 27,29 shown in curves A and B, respectively, are caused primarily by the mechanical resonance of the speaker, and the drive coil 34 appears as a high impedance load. Conversely, the impedance valleys 31, 33 shown in curves A and B, respectively, are a result of a electrical self-inductance of the drive coil 34 and the apparent capacitance of the moving mass due to the cone 26 and the drive coil assembly 34. At the impedance valleys 31, 33, the drive coil 34 appears nearly resistive, and thus becomes a low impedance load. Since these peak and valley resonances are undesirable due to their adverse effect on the low frequency response of the loudspeaker 10, an external feedback circuit 37 is provided which alters the magnitude of the current delivered to the drive coil 34 to compensate for the inherent resonances of the loudspeaker 10.

A current signal is delivered to the drive coil 34 by a broad-band audio amplifier 38. The output of the broad-band amplifier 38 is connected to a terminal 42 on the cabinet 22 by a conductor 40. A lead 35 of the drive coil 34 is also connected to the terminal 42 so that the drive coil 34 is serially connected to the output of the broad-band amplifier 38. As will subsequently become apparent, the current signal is an audio input signal Vin which has been amplified by the audio amplifier 38 and which has been modified by the feedback circuit 37 that delivers a feedback signal to the input of the audio amplifier 38.

Figure 3:
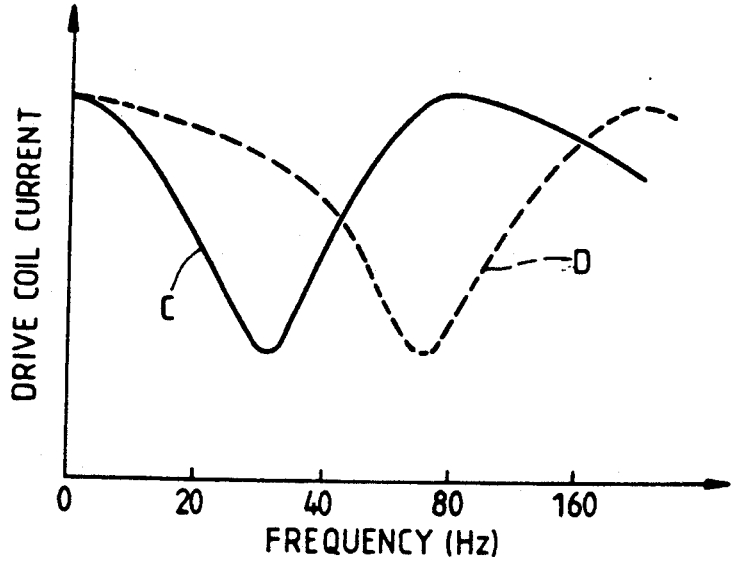
FIG. 3 is graph of the magnitude of the drive coil current vs. frequency as altered by the feedback system of the present invention; an FIG. 4 is a schematic diagram which represents a preferred embodiment of the frequency compensating feedback system and a level compensation network in accordance with the present invention.

Referring to FIG. 3, a curve C illustrates the output of the audio amplifier 38 with feedback which corresponds to the impedance curve A of FIG. 2. Likewise, a curve D illustrates the output of the audio amplifier 38 with feedback which corresponds to the impedance curve B of FIG. 2. The elements of the feedback circuit 37 are selected to offset the effects of the impedance variations shown in curves A and B, depending on whether the speaker 10 is being used in free air or within the enclosure 22, respectively.

Advantageously, the feedback circuit 37 is isolated from the drive coil 34 by a transformer 46. The primary coil 48 of the transformer 46 is connected to a lead 36 of the drive coil 34 via a terminal 44, and the other end of the primary coil 48 is connected to circuit ground. The 10 secondary coil 50 of the transformer 46 is connected to the feedback circuit 37 so that the elements of the feedback circuit are isolated from the drive coil 34. The isolation of the transformer 46 allows the elements of the feedback circuit 37 to operate nearly ideally to cancel the undesirable effects of the loudspeaker 10.

Preferably, the primary coil 48 is comprised of 20 turns of an 18 gauge wire, while the secondary coil 50 is comprised of 200 turns of a 26 gauge wire, thus providing a transformer having a 100:1 impedance transformation. Therefore, the impedance of the secondary coil 50 is much greater than the impedance of the primary coil 48 so that the feedback circuit 37 is buffered from the drive coil 34. For instance, if the value of the secondary coil 50 is 10 millihenries, then the secondary coil 50 has an impedance of 6 ohms at 100 hertz and an impedance of 1.2 ohms at 20 hertz.

A portion of the feedback circuit 37 provides the proper phase and amplitude of the feedback signal in response to the current flowing through the drive coil 34 which is sensed by the transformer 46. The secondary coil 50 is shunted by a resistor 52 which is connected in a parallel arrangement with the secondary coil 50. If the resistor 52 is, for example, 10 ohms, the impedance of the secondary winding 50 is largely inductive below the resonance at 70 hertz and becomes resistive at frequencies above 100 hertz. Therefore, as the frequency of the current signal through the drive coil 34 falls below 70 hertz, the feedback signal Vf at a node 54 becomes progressively smaller in magnitude, as will be explained hereinafter. Since the node 54 is operably connected to the input of the audio amplifier 38, the signal delivered by the amplifier 38 rises in magnitude.

It is desirable to provide an impedance matching network which is the precise electrical equivalent of the loudspeaker 10. To match the response of the loudspeaker 10, a resistor 70, capacitor 72, and an inductor 74 are connected in series between the node 54 and the output of the broad-band amplifier 38 to form a resonance matching network within the feedback circuit 37. The values of the resistor 70, the capacitor 72, and the inductor 74 are selected to match the shape of the impedance curve A or B. Specifically, the inductance and capacitance are tuned to the resonance frequency, and the resistance is added to match the magnitude of the resonance curve A or B. Current flowing through the resonance matching network induces a voltage across a resistor 76 which is connected between the node 54 and the secondary winding 50. (Notice that the feedback signal Vf is the same at nodes 54 and 55 since the impedance of the drive coil 34 is being matched by the impedance matching network.) Therefore, the feedback from the resonance matching network compliments the frequency compensating feedback from the transformer 46, and produces a feedback signal Vf that is relatively unaffected by the loading of the drive coil 34. For example, when the frequency of the audio input signal Vin is near the resonance peak of about 70 hertz, the feedback signal produced by the feedback circuit 37 increases so that the output of the amplifier 38 decreases by an appropriate amount to exactly compensate for the resonant action of the speaker.

To further reduce the feedback signal a the frequency approaches 20 hertz, a capacitor 56 is inserted in the feedback circuit 37 between the node 54 and an input node 58. The input node 58 is connected to the inverting input of an operational amplifier 60 via a resistor 64. A resistor 62 connects the input node 58 to circuit ground, and the values of the capacitor 56 and the resistor 62 are selected to enhance roll-off of the feedback signal at low frequencies. A feedback resistor 66 is connected between the inverting input of the operational amplifier 60 and the output of the operational amplifier 60. Also connected in the feedback loop of the operational amplifier 60 is a capacitor 68. The capacitor 68 is present to roll-off or diminish the high frequency response of the operational amplifier 60.

With the feedback circuit 37 in place, the audio input signal Vin is received at the non-inverting input of the operational amplifier 60. The audio input signal Vin is affected by the feedback of the operational amplifier 6 and by the feedback signal Vf from the feedback circuit 37 because the feedback signal Vf alters the gain of the operational amplifier 60. Therefore, a compensated signal is output to the non-inverting input of the broad-band audio amplifier 38. The output of the broad-band amplifier 38 is delivered to the drive coil 34, and produces a current flow through the drive coil 34. The current through the drive coil 34 produces a magnetic field which cause axial motion of the cylindrical form 32 along the pole piece 18. The current through the drive coil 34 flows through the lead 36 to the connector terminal 44 and to circuit ground via the primary coil 48 of the transformer 46.

Figure 4:
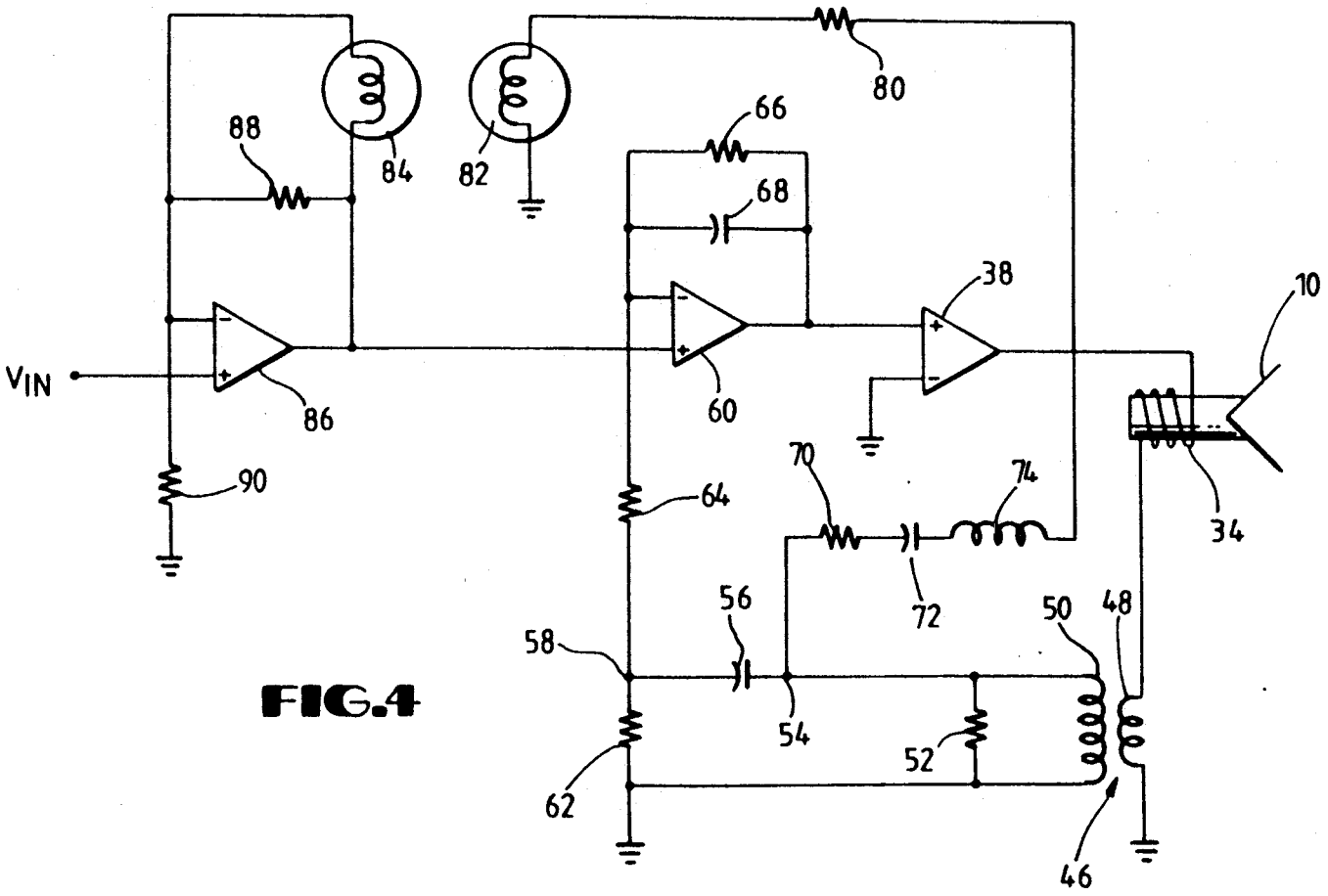

To compensate for the loudness level, i.e., the amplitude of the audio input signal Vin, a level compensation circuit is added to the feedback circuit 37 previously described. As shown in FIG. 4, a resistor 80 and a light emitting element 82, such as a light emitting diode or an incandescent lamp, are connected between the output of the broad-band amplifier 38 and circuit ground. As the amplitude of the signal at the output of the broadband amplifier 38 increases, the current flowing through the resistor 80 and through light emitting element 82 increases. Above a certain level, the current causes the light emitting element 82 to glow, and the radiation emitted from the light emitting element 82 impinges on a photo resistive transducer 84 which is operatively positioned to receive the radiation.

The photo resistive transducer 84 is connected in a feedback loop of an operational amplifier 86 along with feedback resistor 88. When the light emitting element 82 is not emitting radiation, the resistance of the photo resistive transducer 84 is very high compared to the resistance of the resistor 88. Therefore, the gain of the operational amplifier 86 is primarily determined by the feedback resistor 88 and a resistor 90 which is connected between the inverting input of the amplifier 86 and circuit ground. The audio input signal Vin is delivered through the non-inverting input of the amplifier 86 and the amplifier 86 delivers an amplified audio signal to the non-inverting input of the operational amplifier 60. The feedback circuit 37 then modifies the amplified audio signal as previously described.

However, when the light emitting element 82 begins to glow, the radiation received by the photo resistive transducer 84 causes the resistance of the photo resistive transducer to decrease, so that the gain of the operational amplifier 86 is determined by the parallel value of the 15 resistances 84 and 88 as well as by the resistance 90. Since the parallel combination of the resistances 84 and 88 produces a feedback resistance which is less than the value of the resistance 88 alone, the overall gain of the operational amplifier 8 decreases. When the amplitude of the signal at the output of the broad-band amplifier 38 reaches a certain level, the light emitting element 82 glows at a substantially constant intensity. At this substantially constant intensity, the resistivity of the photo resistive transducer 84 is drastically reduced so that the effect of the photo resistive transducer 84 on the feedback of the amplifier 86 is dominant, and therefore allows the amplifier 86 to maintain a substantially constant gain. This substantially constant gain is relatively low compared to the gain of the amplifier 86 when the resistance of the photoresistive transducer 84 is high. Hence, the level compensation circuit smoothly reduces the level of the audio input signal Vin to avoid the undesirable effects of an intense signal.

I claim:

1. An apparatus for enhancing the low frequency response of a loudspeaker, said loudspeaker comprising an acoustic wave producing member, and a drive coil having a first and a second terminal, said drive coil being adapted to produce movement of said member, and said loudspeaker being adapted to be powered by an audio amplifier having an output connected to the first terminal of said drive coil, and having an input adapted to receive an audio input signal, the output of said audio amplifier being adapted to deliver a current signal correlative to the audio input signal, said apparatus comprising:

a feedback circuit being operably connected to said audio amplifier and being tuned to substantially match the impedance of said loudspeaker within a predetermined frequency range; and a transformer having a primary winding and a secondary winding, said primary winding being adapted to connect to the second terminal of said drive coil, and said secondary winding being connected to said feedback circuit, said feedback circuit delivering a feedback signal which alters said audio input signal in response to a voltage induced on said secondary winding b said primary winding.

2. The apparatus, as set forth in claim 1, wherein the feedback signal has a phase and magnitude which alters the audio input signal to cause said audio amplifier to deliver a current signal that is correlative to the audio input signal and that compensates for impedance variations of said drive coil.

3. The apparatus, as set forth in claim 1, wherein said feedback circuit comprises:

a resonance matching circuit being tuned to electrically match the impedance of said loudspeaker within a predetermined frequency range.

4. The apparatus, as set forth in claim 3, wherein:

said resonance matching circuit is operably connected to the output of said audio amplifier, and is adapted to deliver an output signal which modifies the feedback signal in response to the current signal at the output of said audio amplifier.

5. The apparatus, as set forth in claim 4, wherein the output signal modifies the feedback signal in response to the frequency of the current signal at the output of said audio amplifier.

6. The apparatus, as set forth in claim 1, wherein said feedback circuit comprises:

a frequency compensating circuit being adapted to deliver the feedback signal which alters said audio input signal in response to a voltage induced on said secondary winding by said primary winding.

7. The apparatus, as set forth in claim 6, wherein said frequency compensating circuit is connected to said secondary winding of said transformer.

8. The apparatus, as set forth in claim 1, wherein said feedback circuit further comprises:

a level compensation circuit which receives the current signal at the output of said audio amplifier, and reduces the magnitude of audio input signal in response to the magnitude of said current signal being greater than a preselected magnitude.

9. An apparatus for enhancing the low frequency response of a loudspeaker, said loudspeaker comprising an acoustic wave producing member, and a drive coil having a first and a second terminal, said drive coil being adapted to produce movement of said member, said apparatus comprising:

an audio amplifier having an output connected to the first terminal of said drive coil, and having an input adapted to receive an audio input signal, the output of said audio amplifier being adapted to deliver a current signal correlative to the audio input signal;

a feedback circuit being operably connected to said audio amplifier and being tuned to substantially match the impedance of said loudspeaker within a predetermined frequency range; and a transformer having a primary winding and a secondary winding, said primary winding being adapted to connect to the second terminal of said drive coil, and said secondary winding being connected to said feedback circuit, said feedback circuit delivering a feedback signal which alters said audio input signal in response to a voltage induced on said secondary winding by said primary winding.

10. The apparatus, as set forth in claim 9, wherein the feedback signal has a phase and magnitude which alters the audio input signal to cause said audio amplifier to deliver a current signal that is correlative to the audio input signal and that compensates for impedance variations of said drive coil.

11. The apparatus, as set forth in claim 9, wherein said feedback circuit comprises:

a resonance matching circuit being tuned to electrically match the impedance of said loudspeaker within a predetermined frequency range.

12. The apparatus, as set forth in claim 11, wherein:

said resonance matching circuit is operably connected to the output of said audio amplifier, and is adapted to deliver an output signal which modifies the feedback signal in response to the current signal at the output of said audio amplifier.

13. The apparatus, as set forth in claim 12, wherein the output signal modifies the feedback signal in response to the frequency of the current signal at the output of said audio amplifier.

14. The apparatus, as set forth in claim 9, wherein said feedback circuit comprises:

a frequency compensating circuit being connected to said secondary winding of said transformer, and being adapted to deliver the feedback signal which alters said audio input signal in response to a voltage induced on said secondary winding by said primary winding.

15. The apparatus, as set forth in claim 9, wherein said feedback circuit further comprises:

a level compensation circuit which receives the current signal at the output of said audio amplifier, and reduces the magnitude of audio input signal in response to the magnitude of said current signal being greater than a preselected magnitude.

16. An apparatus for enhancing the low frequency response of a loudspeaker, said loudspeaker comprising an acoustic wave producing member, and a drive coil having a first and a second terminal, said drive coil being adapted to produce movement of said member, and said loudspeaker being adapted to be powered by an audio amplifier having an input and an output, the output being connected to the first terminal of said drive coil, said apparatus comprising:

an operational amplifier being adapted to receive an audio input signal and to deliver an amplified audio input signal to the input of said audio amplifier;

a transformer having a primary winding and a secondary winding, the primary winding being adapted to connect to the second terminal of said drive coil;

a feedback circuit having respective inputs operably connected to the secondary winding of said transformer and to the output of said audio amplifier, and having an output connected to the input of said operational amplifier, said feedback circuit delivering a feedback signal in response to a voltage induced on said secondary winding by said primary winding, said feedback signal altering the gain of said operational amplifier, and said audio amplifier delivering a driving signal that is correlative to the amplified audio input signal and that compensates for impedance variations of said drive coil.

17. The apparatus, as set forth in claim 16, wherein said operational amplifier has an input and an output, the output of said operational amplifier being connected to the input of said audio amplifier, and the input of said operational amplifier.

18. The apparatus, as set forth in claim 16, wherein said transformer is operably connected to the output of said audio amplifier and to the input of said operational amplifier.

19. The apparatus, as set forth in claim 16, further comprising a level compensation circuit which receives the current signal at the output of said audio amplifier, and reduces the magnitude of audio input signal in response to the magnitude of said driving signal being greater than a preselected magnitude.

20. The apparatus as set forth in claim 19, wherein said level compensation circuit comprises:

a second operational amplifier having an input and an output, the input of said second operational amplifier being adapted to receive the audio input signal, and the output of said second operational amplifier being connected to the input of said first-mentioned operational amplifier, said second operational amplifier being adapted amplify said audio input signal and to deliver modified audio input signal to the input of said first-mentioned operational amplifier;

a light emitting device being connected to receive the driving signal, said light emitting device emitting light in response to the magnitude of said driving signal being greater than said preselected magnitude; and a photoresistive transducer being adapted to receive light emitted from said light emitting device and to reduce the amplification of said audio input signal in response to said received light.

21. An apparatus for enhancing the low frequency response of a loudspeaker, said apparatus comprising:

a loudspeaker having an acoustic wave producing member, and having a drive coil having a first and a second terminal, said drive coil being adapted to produce movement of said member;

an audio amplifier having an input and an output, the output being connected to the first terminal of said drive coil and being adapted to deliver a current signal correlative to an audio input signal;

an operational amplifier having an input and an output, the input of said operational amplifier being adapted to receive the audio input signal, and the output of said operational amplifier being connected to the input of said audio amplifier, said operational amplifier being adapted to deliver an amplified audio input signal to the input of said audio amplifier;

a resonance matching circuit being tuned to electrically match the impedance of said loudspeaker within a predetermined frequency range, being operably connected to the output of said audio amplifier and to the input of said operational amplifier, and being adapted to deliver a first feedback signal which alters the audio input signal in response to the output of said audio amplifier;

a transformer having a primary winding and a secondary winding, said primary winding being adapted to connect to the second terminal of s id drive coil; and a frequency compensating circuit being connected to said secondary winding of said transformer, and being adapted to deliver a second feedback signal which alters said audio input signal in response to a voltage induced on said secondary winding by said primary winding.

22. The apparatus, as set forth in claim 21, wherein the first and second feedback signals combine to produce a signal having a phase and magnitude which alters the audio input signal to cause said audio amplifier to deliver a current signal that is correlative to the amplified audio input signal and that compensates for impedance variations of said drive coil.

23. The apparatus, as set forth in claim 21, further comprising a level compensation circuit which receives the current signal at the output of said audio amplifier, and reduces the magnitude of the audio input signal in response to the magnitude of said current signal being greater than a preselected magnitude.

24. A method for enhancing the low frequency response of a loudspeaker, said loudspeaker having an acoustic wave producing member and a drive coil which is adapted to produce movement of said member, said method comprising the steps of:

delivering a current signal to said drive coil;

operably connecting an impedance network to receive the current signal, said impedance network having a frequency response substantially the same as the frequency response to said loudspeaker;

sensing current flowing through said drive coil, while being electrically isolated from the impedance of said drive coil; and altering the magnitude of said current signal in response to the frequency of said sensed current.

25. The method, as set forth in claim 24, wherein said step of delivering comprises:

operably connecting an audio amplifier to said drive coil, said audio amplifier being adapted to receive an audio input signal on an input and to deliver the current signal correlative to the audio input signal.

26. The method, as set forth in claim 24, wherein said step of sensing comprises:

operably connecting a primary winding of a transformer to said drive coil and sensing current flowing through a secondary winding of the transformer.

27. The method, as set forth in claim 24, wherein said step of altering comprises:

adjusting the current signal to compensate for the impedance of said loudspeaker.

28. The method, as set forth in claim 27, wherein the current signal is adjusted in proportion to the impedance of said loudspeaker.

* * * * *

UNITED STATES PATENT AND TRADEMARK OFFICE

CERTIFICATE OF CORRECTION

PATENT NO. : 5,086,473

DATED : Feb. 4, 1992

INVENTOR(S) : Louis W. Erath

It is certified that error appears in the above-identified patent and that said Letters Patent is hereby corrected as shown below:

In column 1, line 53, after "loud speaker" insert --,--.

In column 5, line 36, delete "10".

In column 7, line 29, delete "15".

In column 7, line 33, delete "8" and insert --86--, therefor.

In column 10, line 18, after "deliver" insert --a--.

In column 10, line 57, delete "s id" and insert --said--, therefor.

In column 11, line 19, delete "to" and insert --of--, therefor.

Signed and Sealed this

Thirteenth Day of April, 1993

*Attest:*

*Attesting Officer*

STEPHEN G. KUNIN

*Acting Commissioner of Patents and Trademarks*